United States Patent [19]

Neath

[11] 4,046,191

[45] Sept. 6, 1977

[54] SUBSEA HYDRAULIC CHOKE

[75] Inventor: Robert Arthur Neath, Houston, Tex.

[73] Assignee: Exxon Production Research Company, Houston, Tex.

[21] Appl. No.: 593,419

[22] Filed: July 7, 1975

[51] Int. Cl.[2] ..... E21B 7/12

[52] U.S. Cl. ..... 166/.5; 166/75 R; 175/25

[58] Field of Search ..... 166/.5, .6, 75; 175/7, 175/25, 38, 48

[56] References Cited

U.S. PATENT DOCUMENTS

| | | | |
|---|---|---|---|
| 3,155,175 | 10/1964 | Johnson | 175/7 |
| 3,189,098 | 6/1965 | Haeber | 175/7 |
| 3,324,943 | 6/1967 | Price | 175/7 X |
| 3,330,340 | 7/1967 | Hayes et al. | 166/.6 |
| 3,477,526 | 11/1969 | Jones et al. | 175/25 |
| 3,815,673 | 6/1944 | Bruce et al. | 175/7 |

*Primary Examiner*—Ernest R. Purser

*Assistant Examiner*—Richard E. Favreau

*Attorney, Agent, or Firm*—Gary D. Lawson; Salvatore J. Casamassima

[57] ABSTRACT

An improved method and apparatus used for offshore drilling operations is disclosed which is particularly useful in those operations where a floating vessel or drilling platform is situated at the surface of a body of water with a riser assembly extending between the platform and the well and a blowout preventer assembly is positioned therebetween near the lower end of the riser assembly. In the practice of this invention at least one fluid bypass conduit provides a path for high pressure fluid to flow from the wall at a point below at least one of the blowout preventers to the riser assembly at a point below the surface of the water and above the blowout preventer assembly. A means in each of said bypass conduits controls the flow of fluid through the conduit to regulate the fluid pressure in the well when the blowout preventers are in the closed position.

12 Claims, 2 Drawing Figures

SUBSEA HYDRAULIC CHOKE

BACKGROUND OF THE INVENTION

1. Field of the Invention

The present invention pertains to restoring control of a well by regulating pressure in the wellbore while circulating out and killing a kick during drilling operations conducted from a floating vessel or drilling platform at the surface of a body of water.

2. Description of the Prior Art

Drilling operations conducted from floating vessels normally involve the use of marine risers connecting the floating vessel with the wellhead and other equipment on the ocean floor. Such equipment usually includes a blowout preventer control system. The purpose of the blowout preventer system in floating drilling operations is to provide control when a kick occurs and to provide a means of circulating, conditioning, and returning the wellbore to a static condition. Usually, the blowout prevention system includes blowout preventers, a means of controlling release of fluid from the well, and a means of pumping fluid into the well.

Normally, hydrostatic pressure of the drilling fluid column in the well is greater than the pressure of the formation fluid, thus preventing the flow of formation fluids into the wellbore. When a formation with a pressure greater than the hydrostatic pressure in the well is encountered, formation fluids are able to enter the well. The initial influx of formation fluids is commonly referred to as a "kick". As long as hydrostatic pressures control the well, the blowout preventers are in the open position. Should a kick occur, however, blowout prevention equipment and accessories are actuated to close the well.

In most instances, when the blowout preventers are in the closed position due to an occurrence of a kick, additional action is required to restore control of the well. One problem associated with maintaining control can be attributed to the fact that formation fluids entering the well will nearly always contain some gas. This gas is potentially dangerous even if mixed with mud because it can expand greatly when it rises in the well. If the well is shut-in after the entry of appreciable gas and no attempt is made to remove the gas by circulation under controlled conditions, the gas will nevertheless rise in the shut-in well under the influence of gravity, without appreciable expansion. Under these conditions, when the gas reaches the point of shut-in, the pressure at that point may reach such proportions that pressure in the wellbore may result in surface equipment failure, casing failure, or formation breakdown. Such a situation may result in a blowout.

The primary objective in controlling wells which have been invaded by formation fluid is to circulate out any formation fluid influx while maintaining a constant bottomhole pressure slightly greater than the pressure of the formation from the time the well kicks until the weight of the mud in the hole is sufficient to overbalance the formation pressure. To accomplish this objective flow from the annulus is controlled with an adjustable choke so that the pressure of fluid pumped through the drill pipe to circulate out a kick can be controlled to maintain constant bottom hole pressure. By controlling release of fluids from the well the fluid pressure in the well can be regulated to allow for the difference in weight between any heavy fluid being injected into the well and the light mud or gas return fluids and also allow for gas expansion. Controlled release of fluids from the well can also prevent excessive buildup of pressure that may fracture the formation or damage the casing. After the well fluids have passed through the choke, provisions are made for directing the fluids to waste pits, separators, mud tanks, or flares as desired.

In the past, in floating drilling operations controlled release of fluids from the well was accomplished through control lines extending from the blowout preventer or wellhead assembly to the drilling vessel on the surface of the water. Normally control lines would be attached to the outside of the riser assembly. On the floating vessel the high pressure fluids were passed through a choke to regulate the passage of fluid through control lines from below the closed preventer.

In deep water there are several disadvantages in having the wellbore fluid conducted to the vessel in this manner. One disadvantage is the danger that leaks may develop in the control line or in the high pressure choke manifold on the vessel. An uncontrolled release of high pressure fluids on the drilling vessel may endanger the drilling vessel as well as personnel on the vessel. Adverse conditions in the sea will increase the danger that the long, flexible control line may burst or leak. An additional disadvantage in having the high pressure control line extend to the drilling vessel is the problem of imposing an additional pressure on the casing and exposed formation due to dynamic pressure loss in the long control line. A further disadvantage in having high pressure wellbore fluids conducted to the surface may occur with the control line becoming plugged due to the formation of hydrates in the well fluid at the sea floor or before the fluid reaches the surface choke manifold.

SUMMARY OF THE INVENTION

This invention provides an improved apparatus and method for drilling a subsea well which allows control of wellbore pressure while circulating out and killing a kick and at least in part alleviates the difficulties outlined above. The present invention involves allowing fluid to be exhausted from the well at a point below some or all of the blowout preventers by means of at least one fluid conduit having a means in said conduit below the surface of the water to regulate fluid flow.

The improved method and apparatus are particularly useful in drilling operations of the type where a drilling platform fixed or floating on the surface of the water has a riser assembly extending between the drilling platform and the well and a blowout preventer is positioned therebetween near the lower end of the riser assembly. In accordance with the present invention at least one fluid bypass conduit provides a path for high pressure fluids to flow from the well at a point below some or all of the blowout preventer components to the riser assembly at a point below the surface of the water and above the blowout preventer. A means in each of the said bypass conduits controls the flow of fluid through the conduit to regulate fluid pressure in the well after the blowout preventer components are in the closed position.

In the preferred embodiment of this invention two fluid bypass conduits each containing a hydraulic choke may be used to regulate fluid pressure in the well. Each bypass conduit is connected at one end to a blowout preventer assembly and the other end is connected near the lower end of the riser assembly. The blowout preventer assembly may comprise but is not restricted to a stack of four ram-type blowout preventers and two annular-type blowout preventers. The ram-type blowout preventers may comprise three pipe rams designated as the lower, middle, and upper pipe rams and a shear ram positioned above the upper pipe ram. One or more annular-type blowout preventers may be positioned above the shear ram. The lower end of one fluid bypass conduit is connected to the blowout preventer assembly at a point between the upper pipe ram and the middle pipe ram. The lower end of the other fluid bypass conduit is connected to the blowout preventer assembly at a point between the lower pipe ram and middle pipe ram. Each of the bypass conduits contains a hydraulic choke of conventional design for regulating fluid flow through said conduits. A pressure transducer is attached upstream of the hydraulic choke to each of the conduits to monitor the fluid pressure in the well. In addition, each bypass conduit contains two or more valves to control fluid flow through the conduits.

In the practice of the preferred embodiment when a well is closed by blowout preventers, fluid pressure in the well can be regulated by controlled release of fluids from the well. In most instances a well is closed by closing the annular blowout preventers, the upper pipe rams or the middle pipe rams and preventing passage of fluid into the upper control line and bypass conduits. This may be accomplished in the bypass conduits by closing the valves or the chokes, if designed for full closure, and the upper control line by closing valves. When it is desirable to circulate out and kill a kick with the drill pipe at or near bottom, a fluid may be pumped into the drill pipe. Controlled release of fluid from the annulus between the drill pipe and casing below the closed blowout preventer is accomplished by allowing fluid to pass through a fluid bypass conduit which contains a hydraulically activated choke. The choke in each bypass conduit can be adjusted to permit the proper flow rate to maintain a desirable bottomhole pressure. By closing the choke the fluid pressure in the well can be increased and by opening the choke the pressure can be decreased. After passing through the choke, the fluids may be injected into the riser at a point near the lower end of the riser wherein the fluids are transported to a diverter at the top of the riser whose annulus with the drill pipe is sealed by a packer.

In other embodiments of this invention, fluids discharged from the choke may be vented to the sea by opening a valve which communicates with the sea or injected into a low pressure control line which terminates on the drilling vessel.

Each bypass conduit may include a means for monitoring the fluid pressure in the well. After the well is first shut-in, it is often desirable to know the fluid pressure in the well. A pressure transducer attached to each bypass conduit can transmit a signal to the drilling vessel where the pressure can be monitored.

By practicing this invention the problems associated with having the high pressure fluids choked on the water's surface are obviated. Since the high pressure fluids from the well are choked below the surface of the water there is no danger of a release of high pressure fluids on the drilling vessel. In addition, the disadvantages of having a long, flexible control line extending to the drilling vessel are at least in part alleviated since the fluid bypass conduit is connected to the riser below the surface of the water. Thus, there is a decreased danger that the bypass conduit may break or burst due to adverse conditions in the sea and also there is substantially less pressure drop in the bypass conduit. In addition, this invention eliminates plugging of control lines by hydrates. The method and apparatus of the present invention therefore will be seen to offer significant advantages over the systems existing heretofore.

DESCRIPTION OF THE PREFERRED EMBODIMENT

Figure 1:
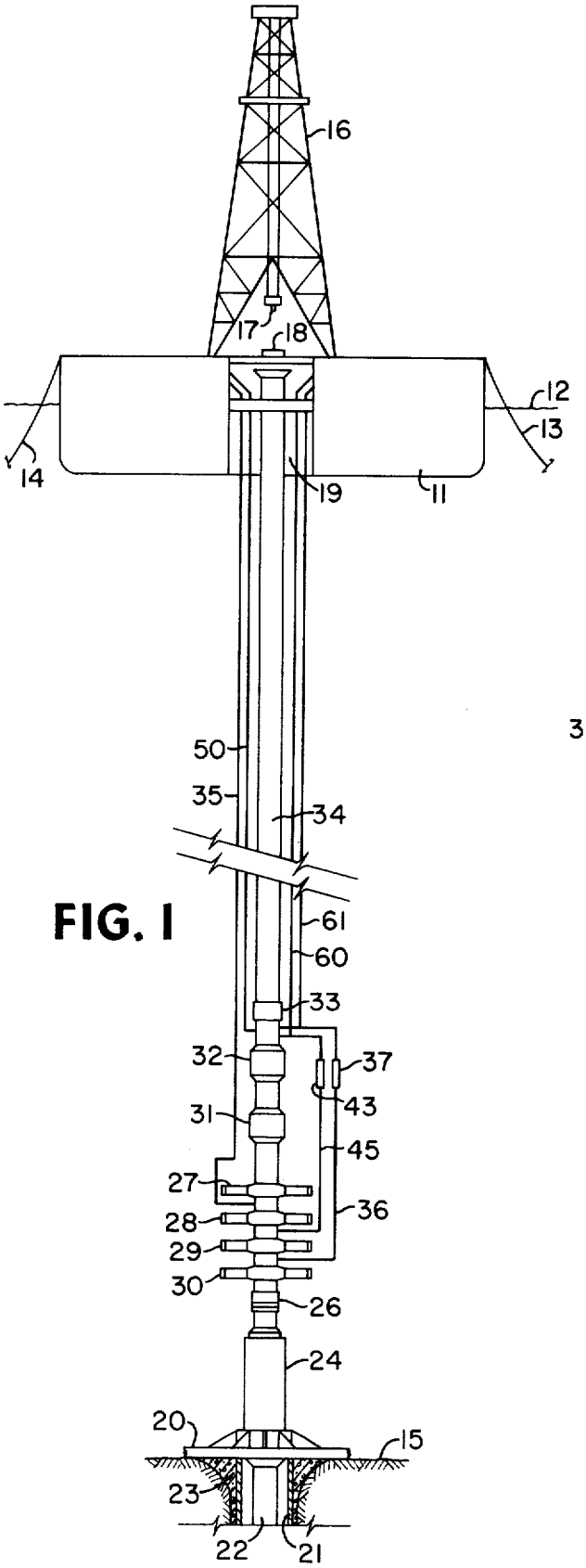
FIG. 1 in the drawing depicts a floating drilling vessel positioned at the surface of a body of water with fluid bypass conduits connecting the lower portion of the blowout preventer with the riser.

The drawings depict one embodiment of the apparatus suitable for the practice of this invention. Shown in FIG. 1 is a drilling vessel 11 positioned at the surface 12 of a body of water overlying an underwater wellhead and related equipment. The drilling vessel is held in position over the location by means of mooring lines 13 and 14 which extend downwardly to anchors (not shown) imbedded in the ocean floor 15. The vessel is equipped with a derrick 16, a hoist system 17, a rotary table 18, and other conventional equipment employed for drilling purposes. The derrick is positioned over a well or slot 19 through which equipment can be raised and lowered.

Figure 2:
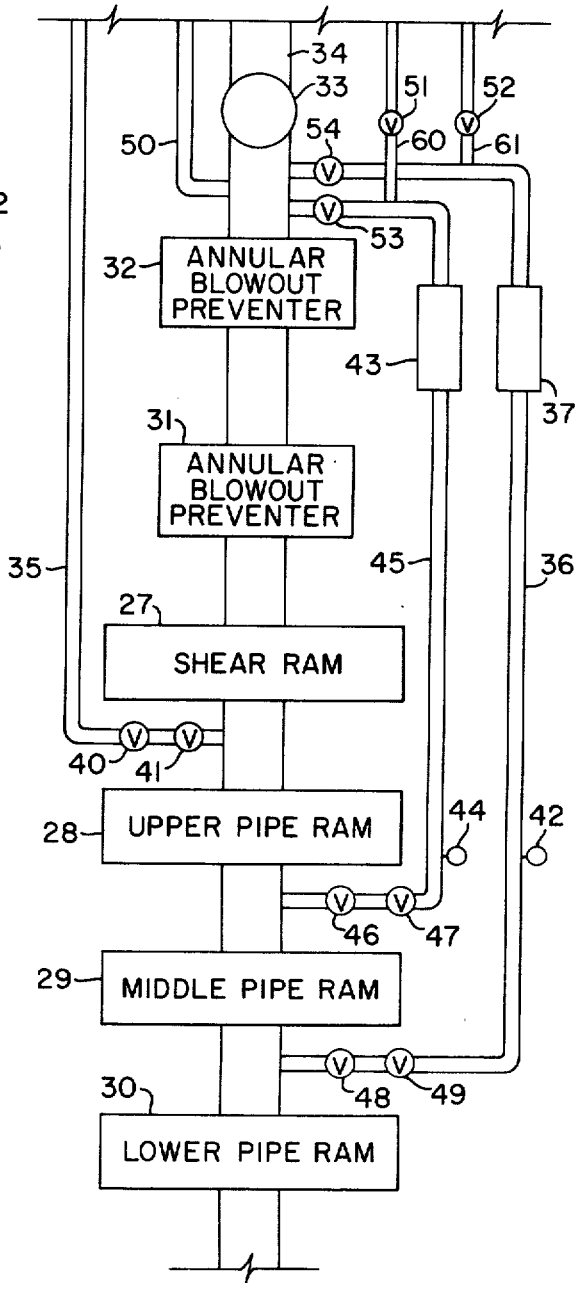
FIG. 2 is an enlarged schematic drawing of fluid bypass conduits connecting the lower portion of a blowout preventer to a riser.

The underwater wellhead assembly depicted in FIG. 1 includes a temporary base member 20 which is positioned on the ocean floor and is secured by a ball-and-socket joint to a conductor pipe 22 extending into the well. The conductor pipe is cemented in place as indicated by reference numeral 23. A casing head nest 24 is attached to the conductor pipe extending through the temporary base member 20. A drilling wellhead assembly above the casing head nest includes a detachable wellhead connector 26 of conventional design. As shown more clearly in FIG. 2, connected above the upper end of this are ram-type blowout preventers 27, 28, 29, and 30, and two annular-type blowout preventers 31 and 32. Blowout preventers 28, 29, and 30 are pipe rams and blowout preventer 27 is a shear ram. A ball joint 33 is connected into the assembly above the blowout preventers and a remotely operated quick disconnect and sealing assembly (not shown in the drawings) may also be employed. A sectionalized marine conductor pipe or riser 34 and upper control line 35 extend upwardly to the drilling vessel at the water's surface.

Fluid bypass conduits 36 and 45 are connected at one end to riser 34 near the annular blowout preventer 32 and at the other end to the blowout preventer system. Bypass conduit 36 is connected to the blowout preventer system at a point between lower pipe ram 30 and middle pipe ram 29. Bypass conduit 45 is connected to the blowout preventer system at a point between the upper pipe ram 28 and middle pipe ram 29. Hydraulic chokes 37 and 43 are situated in bypass conduits 36 and 45, respectively. Also situated in each of the bypass conduits are valves 46, 47, 48, 49, 53, and 54. Pressure transducers 42 and 44 are situated on the bypass conduits 36 and 45 between the hydraulic chokes and blowout preventers.

In the practice of this invention when a kick occurs, formation fluids around the wellbore begin flowing and the blowout preventer system closes the well. Referring again to FIG. 2, the blowout preventer system closes the well by the closing of annular blowout preventers 31 and 32, shear ram 31, or upper pipe ram 28, or any combination of these preventers. Preferably valves 46, 47, 48, 49, 40, 41, 51, 52, 53, and 54 are also in the closed position in order to prevent passage of fluid through the bypass conduits or the upper control line. Preferably the chokes in the bypass conduits are also closed. To return the well to a stabilized condition, mud is injected into the well through a drill pipe to the bottom of the well and returned through the drill pipe-casing annulus. The weight of this mud is increased to exert a hydrostatic pressure slightly greater than the calculated formation pressure in order to stop the influx of formation fluids. The mud density necessary to kill the well can be determined by one of ordinary skill in the art. Selection of the mud injection rate should be made after thorough consideration of the well conditions such as shut in pressure, pump capacity, and frictional losses resulting from circulation. This too can be determined by one skilled in the art. Once stabilized circulation is established the injection rate of the mud should be constant until the well is closed again or until it is killed.

High pressure fluids in the well are allowed to escape through either fluid bypass conduits 36 or 45. It is preferred that only one fluid bypass conduit be used in order to save the other conduit for use in the event the first conduit leaks, bursts, wears out or is otherwise in an inoperable condition. For safety reasons, it is further preferred to use the bypass conduit 45 before using bypass conduit 36. For example, if a leak developed in the system at any point above the middle pipe ram 29, the middle ram could be closed to stop the leak and bypass conduit 36 could alternatively be used for controlled release of fluids from the well.

Hydraulic chokes 37 and 43 regulate the flow of fluid through bypass conduits 36 and 45 respectively. The choke setting at the outset of the killing operation or after a prolonged shut-in period should be such that the annulus pressure during circulation is slightly higher than the shut-in pressure immediately preceding circulation. When circulating a kick out of the well in this manner, the bottom hole pressure is the pressure of the mud column plus whatever overpressure is added to the normal circulating pressure. Therefore, the amount of the overpressure is controlled by the choke pressure. For example, if it is desired to decrease the bottom hole pressure the hydraulic choke can be opened wider and if it is desired to increase the bottom hole pressure the hydraulic choke can be closed more to restrict flow. If the weight of the mud being circulated does not vary the bottom hole pressure will remain constant. However, if the density of the mud increases in a manner as previously stated and the mud is injected at a constant rate the pumping pressure should be reduced to compensate for the increased hydrostatic mud head in order to maintain a constant bottom hole pressure. By adjusting the hydraulic choke in the bypass conduit to control the rate of fluid flow from the well the pressure required to inject the mud can be varied and thus the bottom hole pressure can be maintained at the level desired to prevent formation fluids from flowing into the well.

Bypass conduits 36 and 45 continue past the hydraulic chokes to the riser assembly at a point near the annular blowout preventer 32. In the practice of this embodiment valves 53 and 54 are open and valves 51 and 52 are closed. The bypass conduits may be connected to the riser at any point. However, it is preferred to have the connection as close as practicable to the uppermost blowout preventer component. This is preferable in order to reduce the flowpath of the high pressure fluids through the bypass conduit. By having a short bypass conduit the dynamic pressure losses are decreased and the chance of a leak or break developing in the conduit are reduced. After injection into the riser the fluids are allowed to pass up the riser to a gas diverter positioned at the top of the riser. Although a gas diverter is not always required, it is preferable to use such equipment to divert gas away from the rig. To assist in lifting the muds, formation fluids, and cuttings up the riser and to dilute the gas flowing up the riser, additional fluids may be passed through flowline 50 and injected into the riser at a point near the lower end of the riser.

An alternate route from downstream of the choke or chokes may be to discharge the vented well fluid into low pressure conduits 60 and 61, positioned adjacent to, or attached to the riser by opening valve 51 and closing valve 53 or opening valve 52 and closing valve 54, respectively. In most instances conduits 60 and 61 will be used to transport fluids to the drilling vessel when the riser is damaged.

Another route for fluids from downstream of the choke or chokes may include the discharge of such fluids into the water provided the fluids do not pollute or contaminate the environment. Valving and lines illustrating this embodiment are omitted from FIGS. 1 and 2 for simplicity.

In the event the floating vessel leaves the location in an emergency, which requires cutting the drill pipe and releasing the riser, the drill pipe is suspended in the upper pipe ram 28 and cut in two by activating the shear ram 27 which also seals the wellbore. When the drill vessel returns to the location and the riser is reinstalled, the valves 40 and 41 on the upper control line 35 are opened and fluid is pumped into the upper control line through the cut and suspended drill pipe to the bottom of the well and returns up the annulus and through one of the bypass lines. The returns are controlled by the choke in the bypass line to maintain the pressure required to control the formation pressure. As previously discussed, fluid from the choke may be discharged into the riser, ocean or a separate low pressure line attached to the riser and terminated at a fluid separator on the drill ship.

It should be understood in the practice of this invention one or more bypass conduits containing a choke can be used to control the release of high pressure fluids from the well. At least one bypass conduit is required in the practice of this invention, but as can be appreciated from prior discussion of this invention, more than one bypass conduit is desirable in order to add redundancy to the system.

The hydraulic chokes used in the practice of this invention can be any commercially available choke which can be used to regulate the flow of fluid in the manner as disclosed herein. An example of two commercially available chokes which may be used to practice this invention include: "The Cameron Power Operated Choke" manufactured by Cameron Iron Works Inc. of Houston, Texas, U.S.A. and "Super Choke — 10,000 psi" manufactured by Swaco Operations/-Dresser Industries, Inc. of Houston, Tex. These are adjustable chokes which allow remote changes in choke size which are necessary for the kill procedures previously presented. The hydraulic chokes may be controlled by the blowout preventer control system. More specifically, hydraulic fluids used to operate the blowout preventer system may be used to adjust or regulate the hydraulic choke.

For circulation flexibility and in event the bypass choke line should leak or break, valves are placed in conduit 36 and 45. In most instances dual, hydraulically operated, fail-safe valves are recommended for the outlet of the bypass conduits. Since side outlets are known areas for sand cutting and erosion these valves should be positioned as close to the blowout preventer stack as possible and with a minimum of connections between the stack and the valves. At least one of the valves should be connected directly to the stack and preferably before the flow line or conduit path makes a turn. It would be better if both could be located before this turn in the flow path. However, there is a width restriction on the stack and the valves are vulnerable to being broken off if they extend too far. For these reasons, one valve may be located directly on the stack and the second after the turn in the flow path.

A pressure monitoring means may be connected to the well apparatus to detect fluid pressure in the well. It is preferred that the pressure monitoring means be a pressure transducer connected to each of the bypass conduits between the choke and the well. The pressure transducer may send a signal to the surface indicative of fluid pressure in the well. The signal can be received at the surface and the fluid pressure in the well determined. From such information a well operator can adjust the choke in the appropriate bypass conduit to regulate passage of fluid through the conduit in order to control pressure in the formation. For example, if the fluid pressure in the well is increasing the operator can adjust the hydraulic choke to permit more fluid to pass through the conduit in order to reduce the pressure in the well in a manner as previously described. On the other hand, if the pressure in the well is decreasing, the operator can adjust the choke means to restrict passage of flow through the conduit.

This method of monitoring the high pressure fluid in the well for the adjustment of the hydraulic choke is particularly useful during the period after the well is shut-in and before the fluids are circulated in the well. When muds are pumped into the well at a constant rate and the density of the mud is increasing, in order to maintain a constant bottom hole pressure the pressure required to inject the muds must be allowed to change. By controlling release of fluids through the bypass conduits in a manner as previously described, the pressure required to inject the muds into the well can be varied as desired. Therefore, the operator would be more likely to use a pressure monitoring means to measure the pressure of the muds being injected into the well rather than the fluid pressure in the bypass conduits under those circumstances where a well is being brought under control by the injection of higher density muds.

An automatic choke adjusting means can be used in this invention to regulate the fluid pressure through the bypass conduit. For example, a monitoring means can be connected to the well apparatus to detect fluid pressures in the well. The monitoring means would send a signal to a choke adjusting means which would regulate the choke automatically in response to signals from the monitoring means. If the pressure in the well started to increase the pressure monitoring means would send a signal to the choke adjusting means indicative of this and the choke adjusting means would in turn adjust the choke means to permit more fluid to pass through the conduit and thus reduce the pressure in the well. Generally, the subsea choke can be adjusted to maintain a constant drill pipe pressure in exactly the same manner as when the choke is located at the surface.

It will be understood that the drilling apparatus of this invention is not restricted to the precise configuration illustrated in the drawings and that various changes in the shape or type of fluid bypass conduit, choke valve, or other elements may be made.

What is claimed is:

1. An apparatus for drilling a subsea well from a drilling platform at the surface of a body of water, which comprises a riser conduit extending between the platform and the well;

at least one blowout preventer connected to said riser conduit near the lower end thereof;

at least one fluid bypass conduit providing at least one fluid flowpath from the well at a point below said blowout preventer to the lower interior portion of the riser conduit at a point above the uppermost blowout preventer; and a means in said bypass conduit for regulating fluid flow through said bypass conduit.

2. The apparatus of claim 1 wherein two fluid bypass conduits provide fluid flowpaths from the well at a point below said blowout preventer.

3. The apparatus of claim 1 including valve means in each said fluid bypass conduit.

4. The apparatus of claim 1 wherein the means for regulating fluid flow is a hydraulic choke.

5. The apparatus of claim 4 wherein the hydraulic choke is remotely operable.

6. The apparatus of claim 1 wherein said bypass conduit contains at least one pressure monitoring means situated on each bypass conduit between the means for regulating fluid flow and the well.

7. The apparatus of claim 6 wherein said pressure monitoring means includes a pressure transducer.

8. An apparatus for drilling a subsea well from a drilling platform at the surface of a body of water, which comprises a riser conduit extending between the platform and the well, a blowout preventer assembly comprising at least one blowout preventer connected to the lower end of said riser conduit, at least one fluid bypass conduit providing at least one fluid flowpath between the well at a point below at least one of said blowout preventers to the lower interior portion of the riser conduit at a point above the uppermost blowout preventer; and a means in each said bypass conduit for regulating fluid flow through said bypass conduit.

9. In a method for regulating pressure in a subsea well while circulating out and killing a kick during drilling operations conducted from a drilling platform by equipment which includes a riser conduit extending between the drilling platform at the surface of the water and the well and at least one blowout preventer being positioned therebetween near the lower end of the riser conduit, the improvement comprising conducting well fluids from a point below said blowout preventer to the lower interior portion of the riser conduit at a point above the uppermost blowout preventer by means of at least one fluid bypass conduit; and regulating the passage of fluid through said bypass conduit at a point in said bypass conduit.

10. The method of claim 9 wherein fluid flow through the bypass conduit is regulated in said conduit near the lower end thereof.

11. The method of claim 9 further comprising monitoring the pressure of fluids in the bypass conduit between the means for regulating fluid flow and the well by means of a pressure sensing device, adjusting the means for regulating fluid flow in response to a pressure change in the bypass conduit for controlling fluid pressure in the well.

12. The method of claim 11 wherein the pressure of fluids is monitored by at least one pressure transducer.

* * * * *